US006840334B2

(12) United States Patent
Marquardt

(10) Patent No.: US 6,840,334 B2
(45) Date of Patent: Jan. 11, 2005

(54) GRADER ATTACHMENT FOR A SKID STEER

(76) Inventor: Lonnie L. Marquardt, 3300 Rodeo Rd., Missoula, MT (US) 59803

( * ) Notice: Subject to any disclaimer, the term of this patent is extended or adjusted under 35 U.S.C. 154(b) by 0 days.

(21) Appl. No.: 10/647,085

(22) Filed: Aug. 22, 2003

(65) Prior Publication Data

US 2004/0079541 A1 Apr. 29, 2004

Related U.S. Application Data

(60) Provisional application No. 60/421,339, filed on Oct. 23, 2002.

(51) Int. Cl.[7] ..... E02F 3/85
(52) U.S. Cl. ..... 172/812; 172/795
(58) Field of Search ..... 172/795, 796, 172/797, 811–826; 37/236

(56) References Cited

U.S. PATENT DOCUMENTS

| | | | | |
|---|---|---|---|---|
| 3,716,105 A | | 2/1973 | Hallam | |
| 3,916,624 A | * | 11/1975 | Machens et al. | 60/394 |
| 4,084,644 A | * | 4/1978 | Cole et al. | 172/796 |
| 4,175,625 A | | 11/1979 | Puckett | |
| 4,625,751 A | * | 12/1986 | Gage | 137/118.06 |
| 4,852,660 A | * | 8/1989 | Leidinger et al. | 172/795 |
| 4,930,582 A | | 6/1990 | Goss | |
| 4,989,247 A | | 1/1991 | Springfield | |
| 5,289,880 A | | 3/1994 | Barto | |
| 5,562,398 A | | 10/1996 | Knutson | |
| 5,832,637 A | * | 11/1998 | Aguado et al. | 37/234 |
| 6,109,363 A | | 8/2000 | High | |
| 6,154,986 A | * | 12/2000 | Hadler et al. | 37/234 |
| 6,168,348 B1 | | 1/2001 | Meyer et al. | |
| 6,283,225 B1 | | 9/2001 | Hermonson | |
| 6,315,056 B1 | | 11/2001 | Ransom et al. | |
| 6,354,383 B1 | | 3/2002 | Muilenburg | |
| 6,757,992 B1 | * | 7/2004 | Berger et al. | 37/348 |

FOREIGN PATENT DOCUMENTS

| | | |
|---|---|---|
| WO | WO 87/05350 | 9/1987 |
| WO | 02001020314 A | 1/2001 |

* cited by examiner

*Primary Examiner*—Thomas B. Will
*Assistant Examiner*—Alexandra K. Pechhold
(74) *Attorney, Agent, or Firm*—Saliwanchik, Lloyd & Saliwanchik

(57) ABSTRACT

A grader attachment for a skid steer utilizes the skid steer's auxiliary hydraulics to power an independent hydrostatic steering system for the grader and to control skid steer propulsion and grader blade position. The attachment mounts to the skid steer via a standard mounting connection. The auxiliary hydraulics of the skid steer are routed through a flow control valve and then through a safety valve/back pressure valve before being tapped to control the steering, blade positioning and propulsion systems of the grader. The steering and propulsion systems use a cross bar which connects to the hand control levers of the skid steer. The foot pedal used to control propulsion of the skid steer and attachment has a centering system so that the cylinder goes back to neutral when an operator's foot is removed from the pedal stopping the unit. The blade positioning system utilizes pairs of lift and angle cylinders which allow the blade to be rotated or tilted.

11 Claims, 7 Drawing Sheets

GRADER ATTACHMENT FOR A SKID STEER

CROSS-REFERENCE TO RELATED APPLICATIONS

This application claims priority to U.S. Provisional Patent Application Ser. No. 60/421,339, filed Oct. 23, 2002.

BACKGROUND OF THE INVENTION

Skid steer loaders are versatile machines which are virtually indispensable on many job sites. Skid steer loaders can move dirt and other materials and a skilled driver can use a skid steer to rough grade a surface. A skid steer cannot however provide full grading services. Fine grading requires a blade that can be rotated at the ground's surface and tilted into that surface.

Many grader and grader attachments have been described for skid steers and other equipment which attempt to address the maneuverability required for finish grading. For example, Meyer et al. (U.S. Pat. No. 6,168,348 B1) describes a bi-directional surface leveling system which can be pushed and pulled across a surface to be graded. Several mounting systems have been described that allow the grader blade to be tilted and rotated (U.S. Pat. No. 4,175,625, U.S. Pat. No. 6,109,363, U.S. Pat. No. 6,315,056 B1 and U.S. Pat. No. 6,354,383 B1). Likewise, attachments for tractors, skid steers and other vehicles have been described, each attempting to address the need for fine grading. These references show graders that are pushed ahead of the powered vehicles (U.S. Pat. No. 4,930,582, U.S. Pat. No. 5,562,398, U.S. Pat. No. 6,168,348 B1, U.S. Pat. No. 6,283,225 B1 and Japanese Patent No. JPO200102031A) or pulled behind a powered vehicle (U.S. Pat. No. 3,716,105, U.S. Pat. No. 4,898,247, U.S. Pat. No. 5,289,880 and PCT International Publication No. WO 87/05350). None of these grader attachments however provide the full blade movement and precise control necessary to perform fine grading operations.

Therefore, a need remains for a grader attachment for a small machine, such as a skid steer, that allows that machine to perform with the precision and maneuverability required to complete fine grading operations. The grader attachment should allow the grader block to be rotated across the ground and tilted into the ground. Further, blade position is important to complete fine grading and thus, the attachment should provide a means to accurately control the blade.

All patents, patent applications, provisional patent applications and publications referred to or cited herein, are incorporated by reference in their entirety to the extent they are not inconsistent with the explicit teachings of the specification.

SUMMARY OF THE INVENTION

The subject invention involves a grader attachment for a vehicle. More specifically, the subject invention involves a grader attachment for a skid steer that provides precision control of a multi-positional blade through an independent steering device.

The grader attachment of the subject invention engages a skid steer loader using its standard mounting connection. The grader attachment utilizes the auxiliary hydraulics of the skid steer to power a hydrostatic steering system of the grader. The auxiliary hydraulics of the skid steer are also used to propel the skid steer and attachment as well as to control blade position. The auxiliary hydraulics of the skid steer are routed through a flow control valve and a hydraulic safety valve/back pressure valve. From the safety valve/back pressure valve, the hydraulics are routed to a main equipment valve to control blade position, a steering orbital to control skid steer and attachment steering, and through a back pressure/pressure reducing valve to a hydraulic remote foot control valve to control propulsion of the skid steer and attachment.

DETAILED DESCRIPTION OF THE INVENTION

The grader attachment of the subject invention utilizes the auxiliary hydraulics of the vehicle to which it is attached to control the propulsion and steering of that vehicle as well as to control the position of the grader blade.

Figure 1:
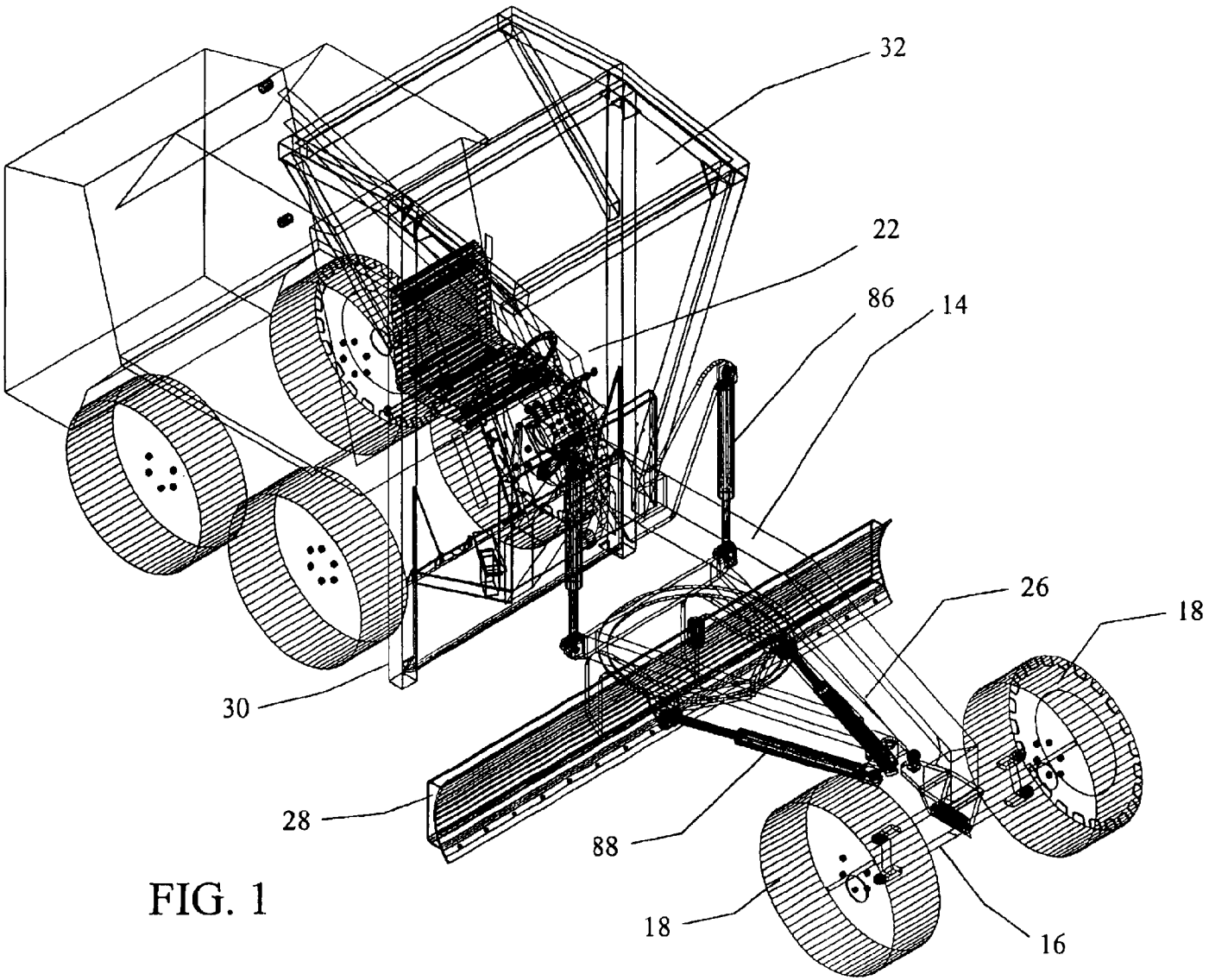
FIG. 1 is a top perspective view of a preferred embodiment of the grader attachment of the subject invention attached to a skid steer.
Figure 2:
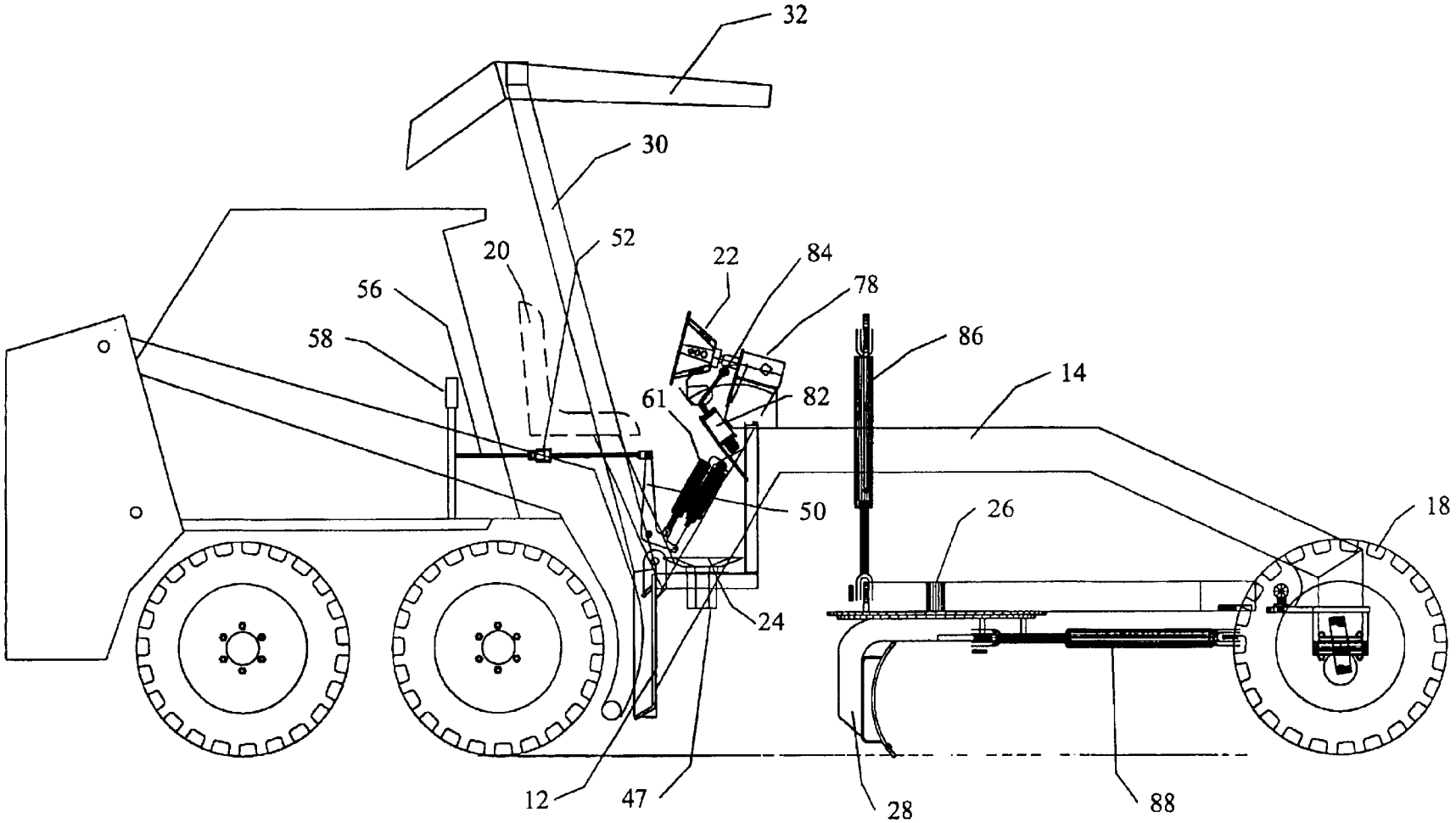
FIG. 2 is a side elevational view of a preferred embodiment of the grader attachment of the subject invention attached to a skid steer.

In a preferred embodiment, the grader attachment of the subject invention attaches to a skid steer. Shown generally at 10 in FIG. 1, the attachment is securably mounted to the skid steer preferably using a standard mounting plate 12. In a particularly preferred embodiment, the attachment is supplemented with a means by which to lock down the lift arm of a skid steer. For example, a hook can be attached to the skid steer and a hook can be attached to the grader attachment frame. The grader's main frame 14 is an elongated overarching beam extending from the proximal end attached to the skid steer at the mounting plate 12 to the distal end having an axle 16 for the grader wheels 18. The frame 14 near the mounting plate 12 supports a seat 20, a steering wheel 22 and a foot pedal 24. An A-frame member 26 supports the blade 28. In a particularly preferred embodiment, the frame has extensions 30 that support a shade canopy 32.

It is known in the art that skid steers are controlled and maneuvered with a pair of hand control levers. Pushing the right hand control lever forward causes the right side wheels of the skid steer to move forward, while the left wheels remain stationary, thus the skid steer turns to the left. A right turn is accomplished by moving the left control lever forward. The skid steer is sent in reverse by pulling back on the hand control levers. Hydraulics raise-and lower the bucket and are controlled by foot pedals on the skid steer.

The grader attachment of the subject invention utilizes the auxiliary hydraulics of the skid steer to steer the vehicle and attachment, to propel the vehicle and attachment and to position the blade of the attachment. The auxiliary hydraulics of the skid steer are routed through a flow control valve and a safety valve/back pressure valve before being routed to power the steering, propulsion or blade control systems. The steering system and the propulsion system are tied to the hand controls of the skid steer. The blade control system rotates the blade about 27 degrees in each direction and tilts the blade into the soil.

Figure 4:
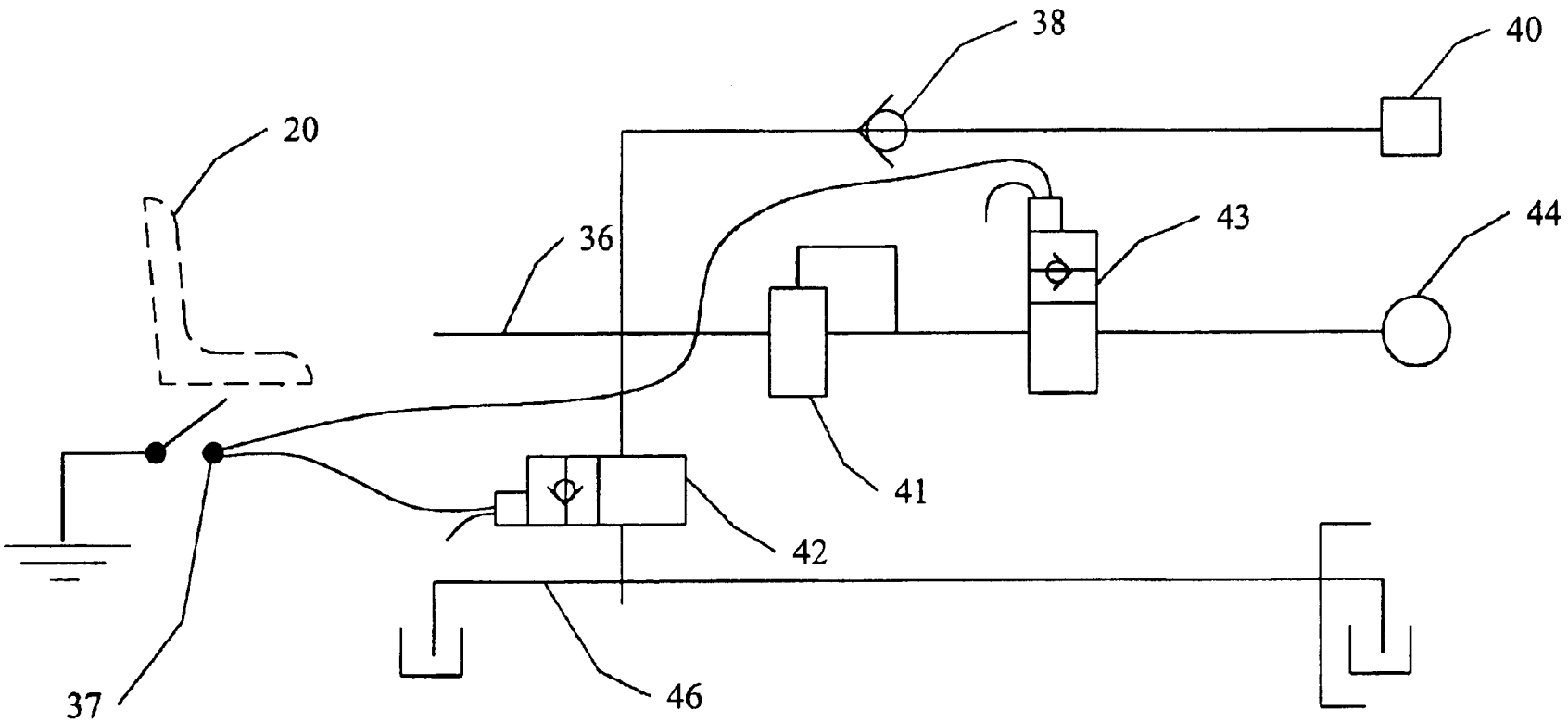
FIG. 4 is a hydraulic schematic of a preferred embodiment of a main hydraulic control valve of the grader attachment of the subject invention.

The auxiliary hydraulics of the skid steer are routed through a flow control valve to regulate the flow of fluid presented to the systems. A safety valve/back pressure valve serves to stop hydraulic fluid flow to each of the steering, propulsion and blade control systems in the absence of the operator. A schematic of a preferred embodiment of this valve is shown in FIG. 4. The safety valve/back pressure valve comprises a 70 pound check valve 38, at least two electric cartridge valves 42 and 43, and a pressure reducing valve 41. Pressurized fluid from the auxiliary hydraulics of the skid steer are routed to port 36. The safety valve/back pressure valve is actuated by an extension of the ignition switch from the skid steer.

A seat safety switch 37 (for example, a standard 12 volt switch as required by OSHA) is connected to electric cartridge valves 42 and 43. When there is no operator in the seat 20 of the grader attachment of the subject invention, fluid from the auxiliary hydraulics of the skid steer flows through valve 42 and tank port 46 to a tank. When an operator is seated in the seat 20 of the grader attachment, valve 42 blocks flow and fluid is directed toward the main equipment valve to control blade position and toward the steering orbital to control steering of the grader attachment and skid steer, and toward the foot controller valve to control propulsion of the skid steer and grader attachment.

Figure 3:
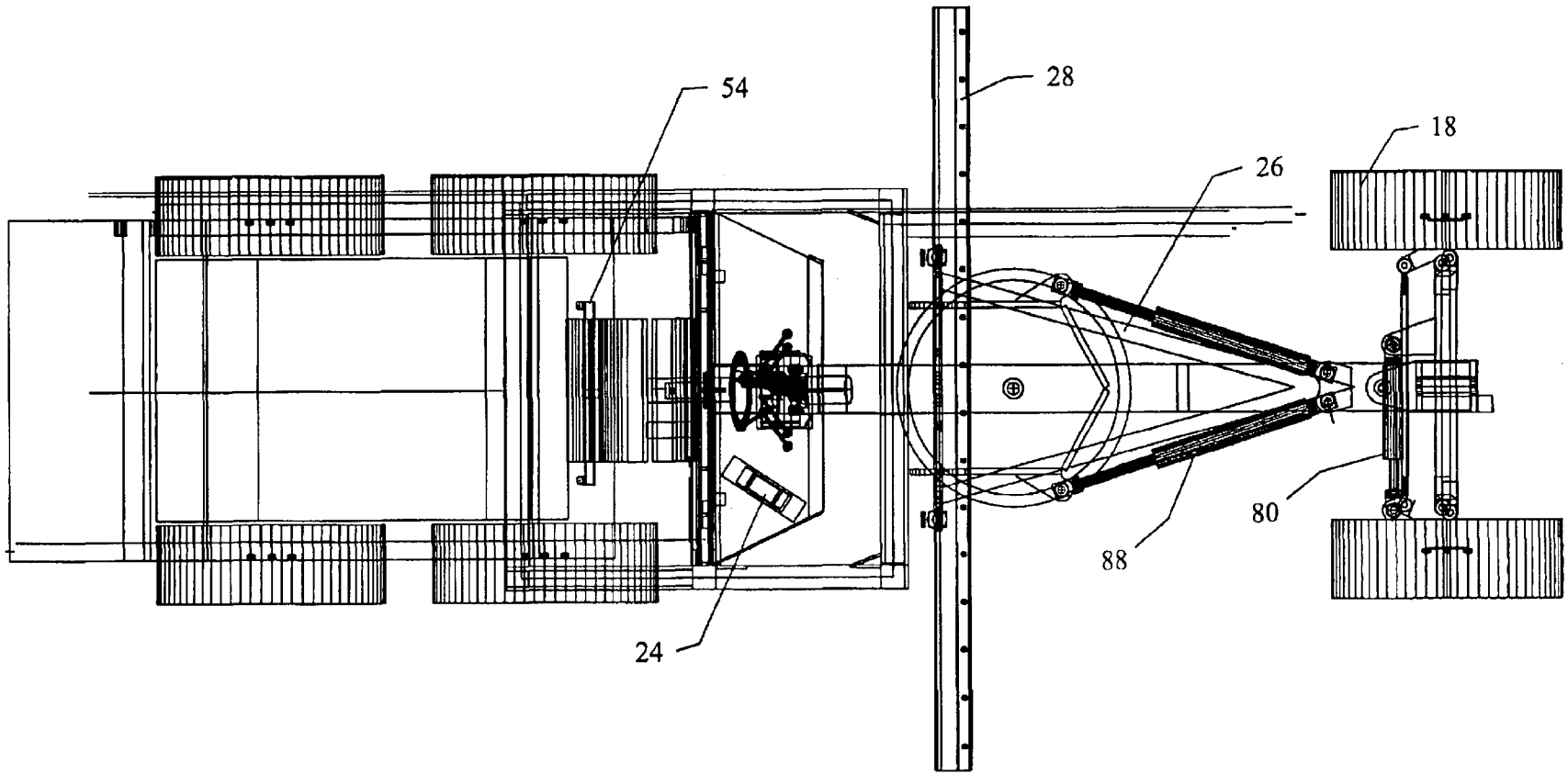
FIG. 3 is a top plan view of a preferred embodiment of the grader attachment of the subject invention attached to a skid steer.

Fluid blocked by electric cartridge valve 42 is checked by a 70 pound check valve 38 to create back pressure with which the foot control valve 47 and foot pedal 24 are operated. Fluid checked by valve 38 is delivered to a pressure reducing valve 41 which limits pressure to no more than 400 pounds. An electric cartridge valve 43 directs fluid to an reduced pressure (RP) port 44 to supply pilot pressure to the hydraulic remote control (HRC) foot control valve 47. Depressing the foot pedal 24, affects the foot pedal control valve 47 which transfers fluid to a travel cylinder 48. The travel cylinder 48 operates a bell crank 50 which strokes a travel rod 52. The travel rod 52 is connected to a travel cross bar 54 (FIG. 3) that engages hand control connecting rods 56 which are quick-connected to the hand controls 58 of the skid steer. Preferably, the travel rod 52 is pivotally connected to the cross bar 54 to allow some independent movement of the hand control levers of the skid steer.

Fluid directed to the rod side 49 of the travel cylinder 48 retracts the rod within the cylinder putting the bell crank in the reverse position. The bell crank pushes the travel rod backward moving the skid steer hand controls 58 backward. The skid steer and attachment therefore move in reverse. Fluid directed to the butt side 51 of the travel cylinder extends the rod out of the cylinder which forces the bell crank into a forward position and the skid steer and attachment move forward. The skid steer and attachment move forward when the pedal 24 is depressed forward and backward when the pedal is depressed rearward.

Figure 5:
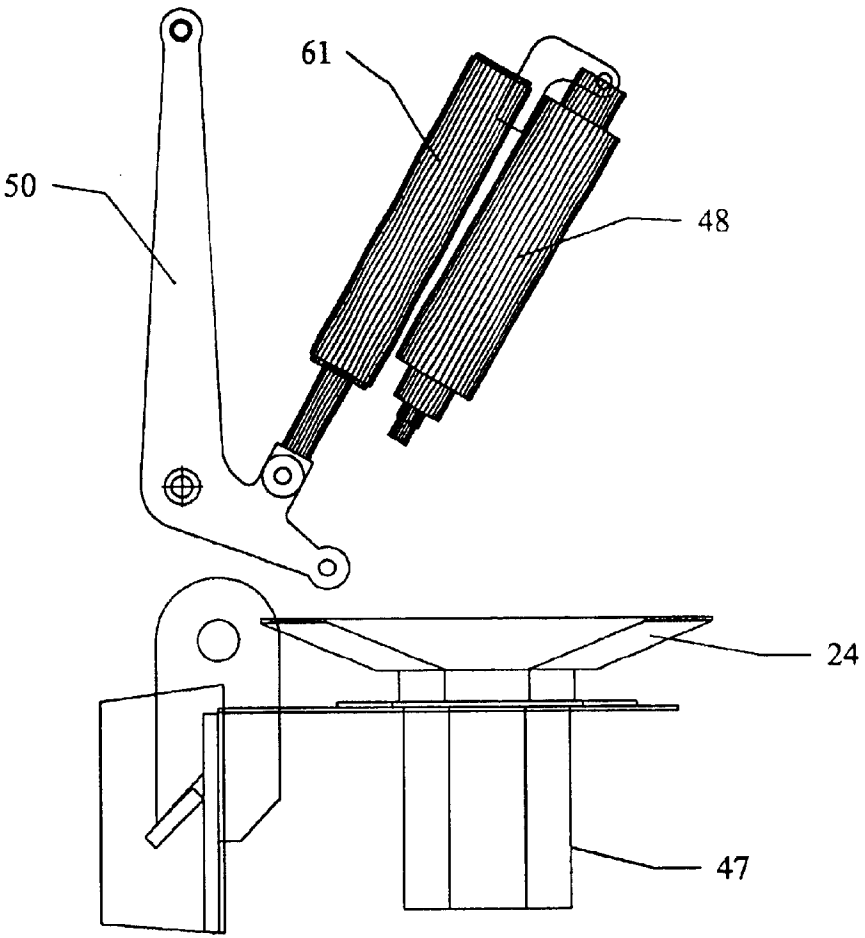
FIG. 5 is a side elevational view of a preferred embodiment of the centering spring, travel cylinder and bell crank of the propulsion system of the grader attachment of the subject invention.
Figure 6:
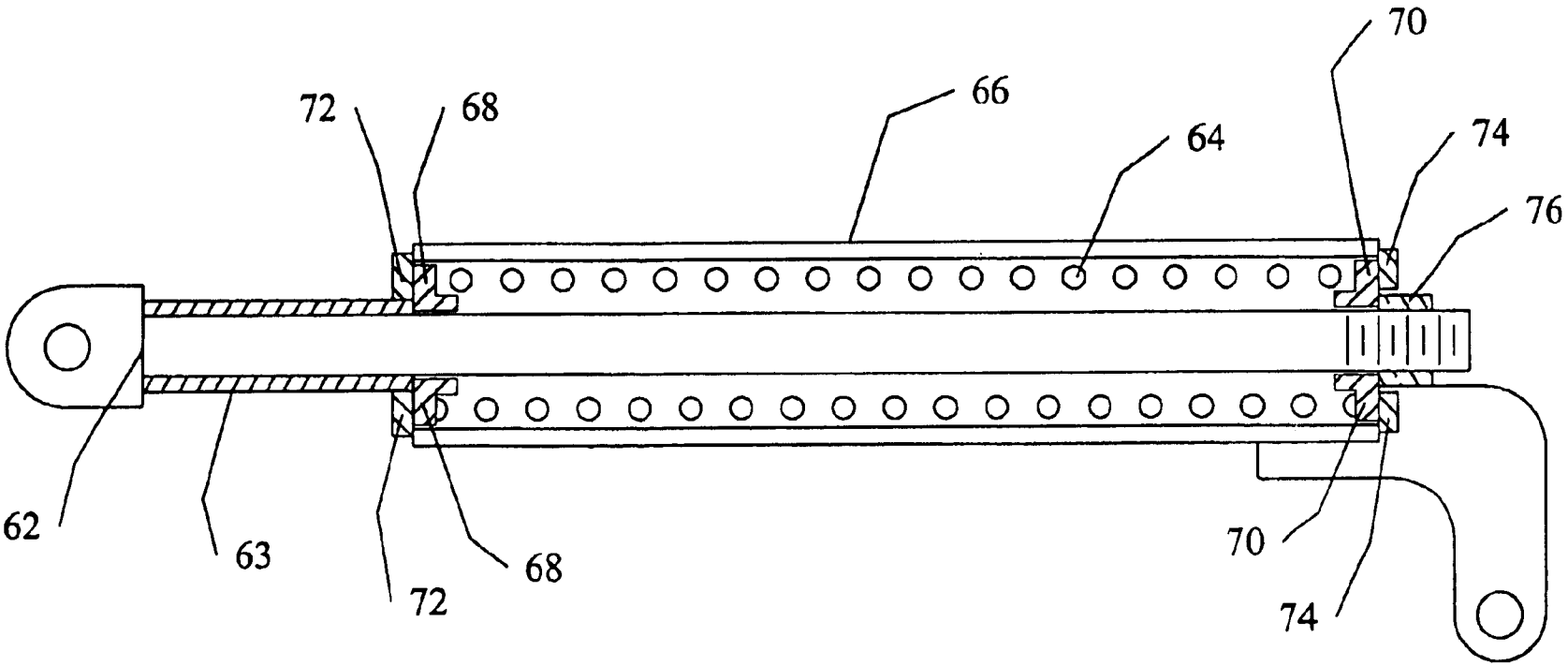
FIG. 6 shows a preferred embodiment of a centering system for the travel mechanism of the grader attachment of the subject invention.

A centering system returns the travel cylinder to neutral when the operator removes the foot from the pedal 24, stopping movement of the skid steer and attachment. In a preferred embodiment of the centering system comprises a centering spring. A particularly preferred embodiment of a centering spring is shown in FIGS. 5 and 6. The centering spring 61 is operably connected to both the travel cylinder 48 and the bell crank 50 (FIG. 5). The centering spring comprises a rod assembly 62 within a spring 64 encased in a spring tube 66. Spring seats 68, 70 rest against end caps 72, 74 which are attached, for example by welding, to the spring tube 66. Preferably, the spring seats 68, 70 are made of aluminum to minimize wear. When in operation, the rod assembly 62 pushes on sleeve 63, spring seat 68 is displaced and the spring 64 compresses (FIG. 6) when the foot pedal 24 is depressed in one direction. Removing a foot from the pedal allows the spring to expand seating the spring against the end cap 72. When the foot pedal 24 is depressed in the other direction, the rod assembly 62 pulls the retaining nut 76 against spring seat 70 displacing it and allowing the spring to compress. Removal of a foot from the pedal allows the spring to expand, seating the spring against end caps 74, leaving the travel cylinder in a neutral position.

Figure 7:
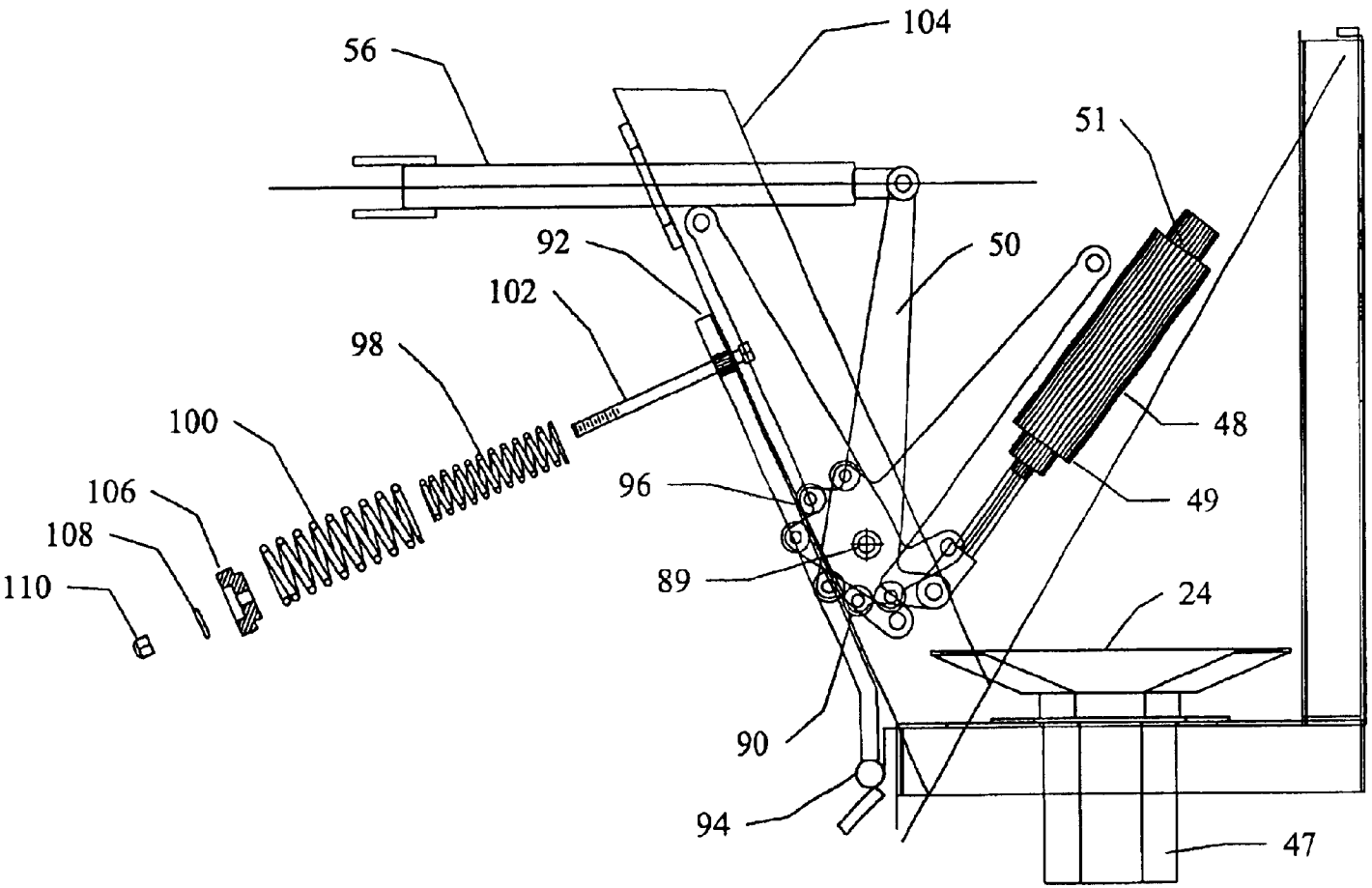
FIG. 7 is a side elevational view of another preferred embodiment of a centering system for the travel mechanism of the grader attachment of the subject invention.

Another preferred-embodiment of a centering system is shown in FIG. 7. This system comprises centering springs, a travel centering bar and centering bearings. As the bell crank pivots about the bell crank pivot point 89 to its forward position, the forward centering bearing 90 engages and moves along a travel centering bar 92 causing the centering bar to pivot at the centering bar hinge 94. When an operator removes his/her foot from the foot pedal 24, the centering bar is forced to return to its rest position against the forward centering bearing 90 and a reverse centering bearing 96 by centering springs 98 and 100. The centering bar moves the bell crank which puts the hand controls of the skid steer in a neutral position stopping the skid steer and grader attachment. The centering springs are attached to the grader on a centering spring bolt 102. The bolt is threaded through a hole in a seat tube 104 and then through an enlarged hole in the centering bar. The inner centering spring 98 and the outer centering spring 100 are then threaded on the bolt and are retained by a spring retainer 106, a washer 108 and a retaining nut 110. The centering system likewise returns a bell crank that is in a reverse position to a neutral position stopping the skid steer and attachment as the centering springs act against the centering bar and bearings.

The blade 28 of the grader attachment of the subject invention can be rotated 27 degrees in each direction and tilted into the ground. Fluid checked by the 70 pound check valve 38 of the hydraulic safety valve/back pressure valve is directed to a main equipment valve. The main equipment valve 82 directs pressurized fluid through control levers 84, to the blade lift cylinders 86, the blade angle cylinders 88 and additional blade adjustment assemblies. Additional blade adjustment assemblies can include, for example, cylinders which allow the blade to be tilted forward and back and shifted side to side across the surface of the ground.

The main equipment valve 82 also has a main relief valve and a power beyond plug to channel hydraulic fluid to the steering orbital 78, and steering cylinder 80. When the steering wheel 22 of the grader attachment is set in motion to the right, the cylinder retracts. The front wheels 18 of the attachment turn to the right and the wheels of the skid steer follow, turning the skid steer and attachment to the right. When the steering wheel 22 is set in motion to the left the cylinder extends, turning the front wheels to the left, and the skid steer and grader attachment turn to the left. The independent steering system of the grader attachment of the subject invention allows the operator to sit above the blade 28 where the blade can be controlled with precision and accuracy.

It is understood that the foregoing examples are merely illustrative of the present invention. Certain modifications of the articles and/or methods employed may be made and still achieve the objectives of the inventions. Such modifications are contemplated as within the scope of the claimed invention.

What is claimed is:

1. A grader attachment for a loader type utility vehicle which utilizes the auxiliary hydraulics of that vehicle comprising:

an elongated frame member having a proximal end for attachment to the vehicle and a distal end with at least one steerable wheel;

a blade positioned between the proximal end and the distal end of the elongated frame member;

a blade control means;

a steering means;

a propulsion control means; and a safety valve/back pressure valve comprising a check valve, a first electric cartridge valve, an at least second electric cartridge valve, and a pressure reducing valve, the safety valve/back pressure valve receiving fluid from the auxiliary hydraulics of the vehicle;

wherein the fluid is directed through the first electric cartridge valve to a tank port when the attachment is not in use;

wherein the fluid is blocked by the first electric cartridge valve when the attachment is in use; and the fluid is directed to the check valve, fluid passing through the check valve is directed through a main equipment valve to the blade control means, the main equipment valve comprising a main relief valve and a power beyond plug to direct fluid to the steering means; and fluid blocked by the check valve is directed through the pressure reducing valve and through the second electric cartridge valve through a hydraulic remote control valve to the propulsion control means;

whereby the safety valve/back pressure valve provides fluid under pressure to control the steering of the vehicle and the attachment, to control the propulsion of the vehicle and the attachment and to control the movement of the blade by utilizing the auxiliary hydraulics of the vehicle.

2. The grader attachment of claim 1, wherein said blade control means comprises at least one control lever, and at least one blade positioning cylinder.

3. The grader attachment of claim 2, wherein said at least one blade positioning cylinder includes at least one blade lift cylinder to lift said blade from a ground surface and at least one blade angle cylinder to rotate said blade across the ground surface.

4. The grader attachment of claim 3, wherein said at least one blade positioning cylinder further includes at least one blade tilt cylinder to tilt said blade into said ground surface.

5. The grader attachment of claim 1, wherein steering means comprises a steering orbital and a steering wheel.

6. The grader attachment of claim 1, wherein said propulsion control means comprises an operator control means by which an operator can control propulsion of said vehicle and attachment, said hydraulic remote control valve providing fluid to a travel cylinder, the travel cylinder operably connected to a bell crank and the bell crank operably connected to connecting means which connect the bell crank to the hand controls of said vehicle.

7. The grader attachment of claim 6, wherein said connecting means include a travel rod stroked by said bell crank, a travel cross bar pivotally connected to the travel rod, and hand control connecting rods that connect to said hand controls of said vehicle.

8. The grader attachment of claim 6, wherein said operator control means is a foot pedal.

9. The grader attachment of claim 6, further comprising a centering system to return said travel cylinder to neutral when said operator releases said operator control means.

10. The grader attachment of claim 9, wherein said centering system comprises a centering spring operably connected to said travel cylinder, the centering spring comprising a rod assembly comprising a rod and a sleeve, a portion of the rod is surrounded by a spring member, the rod and spring member are encased in a spring tube, the spring tube including two end caps, each end cap comprising at least one spring seat, wherein moving said travel cylinder by moving said operator control means of said vehicle compresses the spring and releasing said operator control means allows the spring to expand and to seat on the seat members.

11. The grader attachment of claim 9, wherein said centering system comprises a travel centering bar, a centering spring, and at least a forward centering bearing and at least a reverse centering bearing, wherein moving said travel cylinder by moving said operator control means of said vehicle causes said bearings to move along the travel centering bar causing the travel centering bar to pivot on a hinge and releasing said operator control means causes the spring to return said centering bar to neutral.

* * * * *